United States Patent [19]

Wooster

[11] 4,290,530

[45] Sep. 22, 1981

[54] APPARATUS FOR STORING AND DISPLAYING RECORD ALBUMS

[76] Inventor: Kirk A. Wooster, 445 Bishop St. N.W., Atlanta, Ga. 30318

[21] Appl. No.: 75,407

[22] Filed: Sep. 14, 1979

[51] Int. Cl.[3] ..... A47F 7/00

[52] U.S. Cl. ..... 211/40; 211/186

[58] Field of Search ..... 211/40, 45, 186, 50; 108/111

[56] References Cited

U.S. PATENT DOCUMENTS

| | | | |
|---|---|---|---|
| 2,636,432 | 4/1953 | Sherer | 211/50 X |
| 3,337,059 | 8/1967 | Lettoy | 211/40 X |
| 3,471,029 | 10/1969 | Dolan | 211/13 |
| 3,599,799 | 8/1971 | Herrli et al. | 211/40 |
| 4,015,545 | 4/1977 | Kurokawa | 108/111 X |
| 4,102,458 | 7/1978 | Fors | 211/40 X |

*Primary Examiner*—Roy D. Frazier
*Assistant Examiner*—Robert W. Gibson, Jr.
*Attorney, Agent, or Firm*—Robert B. Kennedy

[57] ABSTRACT

Apparatus is disclosed for storing and displaying record albums comprised of a frame and means for mounting the frame to a wall. The frame has an upright side wall from which slide trays laterally extend and upon which albums may be positioned one behind the other to form a stack and later slid partially off the trays to reveal underlying stack members.

2 Claims, 6 Drawing Figures

APPARATUS FOR STORING AND DISPLAYING RECORD ALBUMS

BACKGROUND OF THE INVENTION

This invention relates to apparatuses for storing and displaying record albums.

Heretofore racks have been devised for storing record albums of the type wherein a disc-shaped record is stored in a rectangular jacket. These racks have typically comprised a series of mutually parallel, arcuate spring bars mounted atop a base forming a set of upright slots in which the albums may be individually stood one behind the other. To identify and select an album for play the top of the albums are manually flipped whereupon albums in front of others may be momentarilly separated for viewing. Upon releasing the albums the resilient spring bars in which they are supported cause the set to return to their normal upright positions.

Though the just described racks do function adequately as a storage means, their use in displaying a collection of record albums is very limited. To view the set one must flip through the collection and even then ordinarily only see an upper portion of any one album other that that one located in front of the stack. Yet to display all albums with other means for a sizable collection would normally be impractical due to space limitations.

Accordingly, it is a general object of the present invention to provide improved apparatus for storing and displaying record albums.

More specifically, it is an object of the invention to provide apparatus for storing and displaying record albums in which a plurality of albums may be simultaneously viewed without manual aid.

Another object of the invention is to provide apparatus for storing and displaying record albums upon which albums may be easily positioned for storage and easily repositioned for momentary scanning.

Another object of the invention is to provide apparatus for storing and displaying record albums of the type described of modular construction which may be easily expanded and contracted to accomodate variable size record album collection sizes and available space for their storage and display.

Yet another object of the invention is to provide apparatus of the type described which may be easily assembled and dissembled.

SUMMARY OF THE INVENTION

In one preferred form of the invention apparatus is provided for storing and displaying record albums of selected thickness and height comprising a frame and means for mounting said frame to a wall. The frame has an upright side wall from which at least two slide trays of widths in excess of the record album thickness laterally extend in mutually parallel relation spaced one above the other a distance in excess of the album height, and a pair of upright supports mounted to the ends of the slide trays distal the upright side wall. So constructed the frame may be mounted to a wall and sets of record albums slid between the pair of upright supports and stacked one behind the other on the slide trays for storage and display, and members of each record album set later slid partially back through the supports and partially off the slide trays to reveal underlying record albums in the stacks.

DESCRIPTION OF THE PREFERRED EMBODIMENTS

Figure 1:
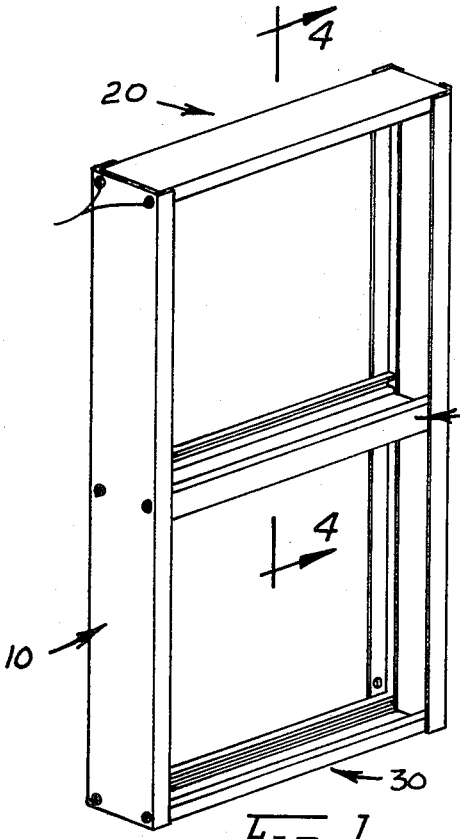
FIG. 1 is a perspective view of apparatus embodying principles of the invention in one preferred form.
Figure 2:
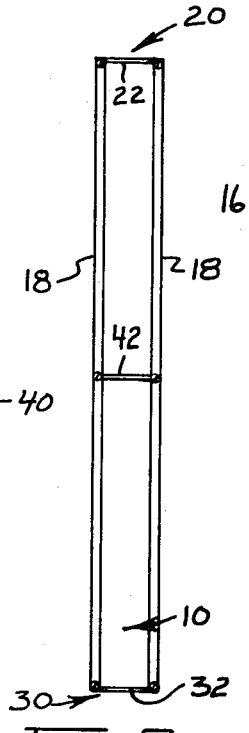
FIG. 2 is a side elevational view of the apparatus shown in FIG. 1.

Referring now in more detail to the drawing, there is shown in FIGS. 1–4 apparatus for storing and displaying record albums comprising a frame having an upright side wall 10 of channel-shaped structure having a flat web section spanning two mutually parallel flange sections 12. The frame also has a pair of upright supports 14 in the form of angle irons having sides 16 lying in the planes of wall flange sections 12 from which coplanar sides 18 angularly extend. The top of the side wall 10 is joined to the tops of supports 14 by a top support 20 which also is in the general form of a channel having a flat web 22 from the sides of which two mutually parallel flanges 24 depend to reentrant lips 26. The edges of these lips terminate at the edges of sides 18 of the supports 14. The bottom of the side wall 10 is also joined to the bottom of supports 14 by another structure of identical size and shape as the top support 20 but which is inverted to provide a lower slide tray 30 having a flat web 32 from the sides of which two mutually parallel flanges 34 extend to reentrant lips 36. The frame further includes an upper slide tray 40 which has a flat web 42 from the sides of which flanges 44 extend both above and below the web. These flanges also unitarily merge with reentrant lips 46 which have a width matching that of sides 18 of supports 14.

Figure 4:
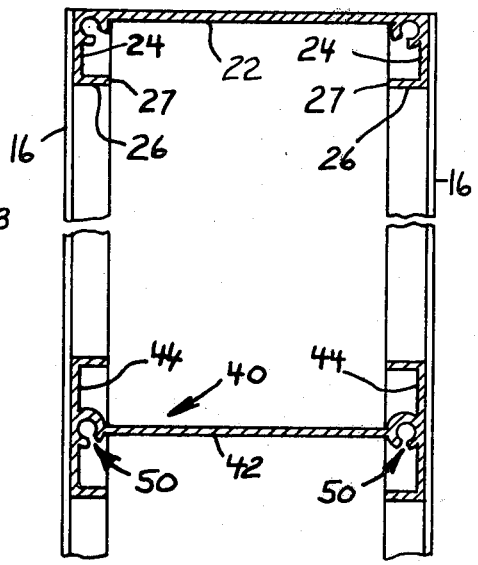
FIG. 4 is a cross sectional view of the apparatus shown in FIG. 1 taken along plane 4—4.
Figure 3:
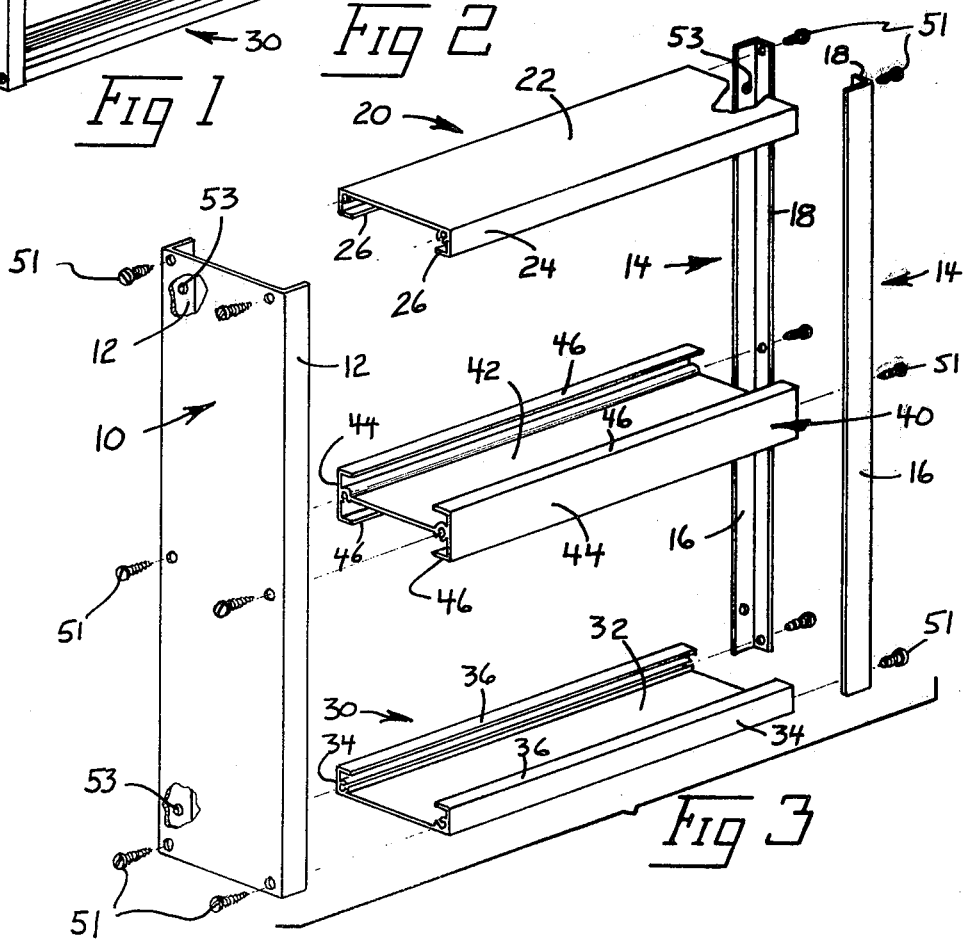
FIG. 3 is an exploded view of the apparatus illustrated in FIG. 1.

As best shown in FIG. 4, the top support 20 and upper and lower slid trays are each formed by extrusion with rounded grooves 50 at the juncture of their web and flange portions which grooves extend the full length of the structures. These grooves are sized to threadedly receive screws 51 passed through holes in the side wall 10 and upright supports 14 thereby rigidly fastening the top support and slide trays to the side wall and upright supports. With the frame so assembled it may then be mounted to a wall with other screws passing through holes 53 in the sides 16 of an upright support and a flange section 12 of the side wall.

Figure 6:
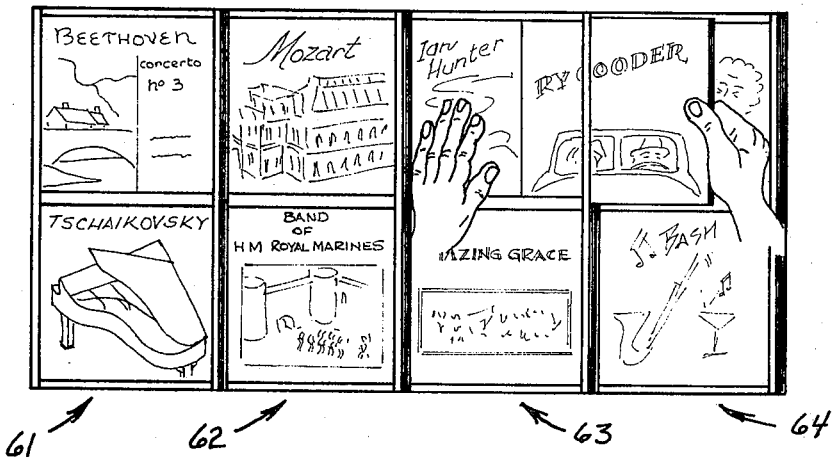
FIG. 6 is a front elevational view of the apparatus shown in FIG. 5 loaded with record albums.

Once mounted to a wall record albums may be passed between the upright supports onto slide trays 30 and 40 and formed into two stacks of albums, positioned one behind the other for storage and display. When it becomes desirable to examine the underlying members of a stack the front members are manually slid partially through the side supports and partially off a tray as shown in FIG. 6. When an album is selected those other albums that are partially off the tray may be repositioned onto the tray behind the remaining members in the stack and a disc pulled from the front album jacket for play. When play is completed the disc may be easily replaced in its jacket which has remained as the front member of the stack.

Figure 5:
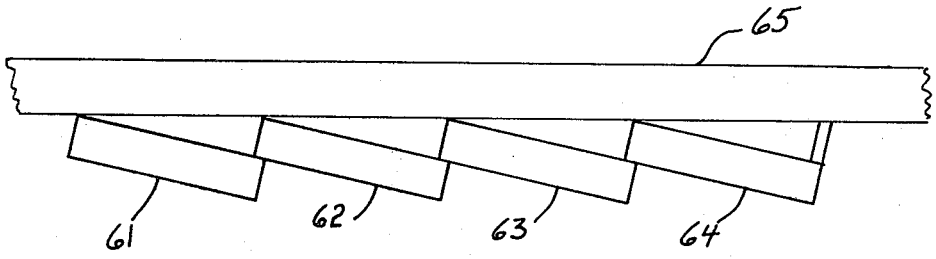
FIG. 5 is a plan view of apparatus embodying principles of the invention in another preferred form.

Though the apparatus shown in FIGS. 1-4 has but two slide trays, it may, of course, have more thereby assuming a taller stance. Furthermore, several of these frames may also be assembled in modular form side by side as shown in FIGS. 5 and 6 in a staggered formation with an upright side support of one frame module overlaying and being fastened to the flange portion of the side wall of the next successive frame module. For this screws are again used that are inserted into aligned holes. Thus, in FIGS. 5 and 6 four frame modules 61, 62, 63 and 64 are seen to be mounted to a wall 65 and to each other together with an end spacer 66. The staggered arrangement insures ready access to the trays of each frame module through the upright supports of each as illustrated in FIG. 6. If desired the modules may be positioned with no overlap and fastened together with right angle brackets.

It should be understood that the just described embodiments merely illustrate principles of the invention in selected forms. Many modifications, deletions and additions may, of course, be made thereto without departure from the spirit and scope of the invention as set forth in the following claims.

What is claimed is:

1. Apparatus for storing and displaying record albums of selected thickness and height comprising a plurality of frames and means for mounting said frames to a wall, and with each frame having an upright side wall from which at least two slide trays of widths substantially in excess of said record album thickness laterally extend in mutually parallel relation spaced one above the other a distance in excess of said album height, and a pair of upright supports mounted to the ends of said slide trays distal said upright side wall; and means for securing said frames together in a staggered formation with an upright support of one frame overlaying and being secured to a side wall of the other frame; whereby the plurality of frames may be mounted to a wall and sets of record albums slid between the pair of upright supports and stacked one behind the other on the slide trays for storage and display, members of each record album set sequentially slid partially back through the supports and partially off the slide trays to reveal record albums therebehind, and access provided to stacks of albums supported upon the trays of each frame.

2. Apparatus for storing and displaying record albums of selected thickness and height comprising, in combination, an upright side wall of channel-shaped structure having a web spanning two mutually parallel flanges; at least two slide trays of widths substantially in excess of a record album thickness mounted by screws at one end thereof to said side wall at positions spaced one above the other a distance in excess of the album height with at least one of said slide trays having a web spanning and merging with two upright sides at junctures that define a rounded groove in which said screws are threated and with each side extending above and below said tray web and formed with flanges that extend generally parallel with said web respectively above and below said juncture groove; a pair of angle irons mounted to opposed corners of the other end of said slide trays by screws threated into said slide tray grooves; and means for mounting the apparatus to a wall, whereby the frame may be mounted to a wall and sets of record albums slid between the angle irons and stacked one behind the other on said slide trays for storage and display, and members of each record album set sequentially slid partially back through the supports and partially off the slide trays to reveal record albums therebehind.

* * * * *